US011280248B2

(12) United States Patent
Kitano et al.

(10) Patent No.: US 11,280,248 B2
(45) Date of Patent: Mar. 22, 2022

(54) GENERAL-PURPOSE ENGINE

(71) Applicant: HONDA MOTOR CO., LTD., Tokyo (JP)

(72) Inventors: Sho Kitano, Saitama (JP); Yuji Oigawa, Saitama (JP); Kiichi Shimamura, Saitama (JP); Masanori Ishikawa, Saitama (JP); Shohma Higano, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/042,202

(22) PCT Filed: Mar. 30, 2018

(86) PCT No.: PCT/JP2018/013838
§ 371 (c)(1),
(2) Date: Sep. 28, 2020

(87) PCT Pub. No.: WO2019/187082
PCT Pub. Date: Oct. 3, 2019

(65) Prior Publication Data

US 2021/0017896 A1 Jan. 21, 2021

(51) Int. Cl.
*F02B 63/00* (2006.01)
*F01P 5/06* (2006.01)
(Continued)

(52) U.S. Cl.
CPC ..... *F01P 5/04* (2013.01); *F01P 1/06* (2013.01); *F01P 5/06* (2013.01)

(58) Field of Classification Search
CPC ... F02B 63/00; F02B 63/02; F01P 1/06; F01P 5/06
See application file for complete search history.

(56) References Cited

U.S. PATENT DOCUMENTS 4,332,220 A * 6/1982 Itzrodt ..... F01N 13/002 123/41.7
6,279,522 B1 * 8/2001 Balzar ..... F01L 1/02 123/90.1
(Continued)

FOREIGN PATENT DOCUMENTS

CN 102121417 A 7/2011
CN 106014587 A 10/2016
(Continued)

OTHER PUBLICATIONS

Extended European Search Report issued in the EP Patent Application No. 18913052.9, dated Dec. 17, 2020.
(Continued)

*Primary Examiner* — Long T Tran
(74) *Attorney, Agent, or Firm* — CKC & Partners Co., LLC

(57) ABSTRACT

Provided is a general-purpose engine having a sufficient cooling function. A general-purpose engine 1 is provided with: an engine body 10 which has an exhaust system component 13 connected to a cylinder 11; and a cooling mechanism 9 which cools the engine body 10. The cooling mechanism 9 is provided with: a cooling fan 90 which rotates to generate a cooling air flow; a discharge section 92 which discharges the cooling air flow generated by the rotation of the cooling fan 90; and an air guide 93 which guides, toward the cylinder 11 and the exhaust system component 13, the cooling air flow discharged from the discharge section 92.

9 Claims, 10 Drawing Sheets

(51) Int. Cl.
*F01P 5/04* (2006.01)
*F01P 1/06* (2006.01)

(56) References Cited

U.S. PATENT DOCUMENTS

| | | | | |
|---|---|---|---|---|
| 6,331,740 | B1 | 12/2001 | Morohoshi et al. | |
| 2008/0092840 | A1* | 4/2008 | Yuasa | F02M 1/16 123/179.11 |
| 2012/0180322 | A1* | 7/2012 | Takeda | F01M 11/065 30/276 |
| 2013/0133597 | A1* | 5/2013 | Shimazaki | F01L 1/047 123/90.15 |
| 2013/0247896 | A1* | 9/2013 | Andersson | F01N 13/1888 125/13.01 |
| 2016/0281576 | A1 | 9/2016 | Takahashi et al. | |
| 2018/0016956 | A1 | 1/2018 | Ichihashi et al. | |
| 2018/0371990 | A1* | 12/2018 | Schenkel | F02F 7/0058 |

FOREIGN PATENT DOCUMENTS

| | | | |
|---|---|---|---|
| CN | 106285893 | A | 1/2017 |
| EP | 2816209 | A2 | 12/2014 |
| JP | S443686 | Y1 | 2/1969 |
| JP | S5279437 | U | 6/1977 |
| JP | S53117842 | U | 9/1978 |
| JP | S5962227 | U | 4/1984 |
| JP | H04330319 | A | 11/1992 |
| JP | 2000328940 | A | 11/2000 |
| JP | 2017053233 | A | 3/2017 |
| JP | 2017096123 | A | 6/2017 |
| TW | I316584 | B | 11/2009 |
| WO | 2016136386 | A1 | 9/2016 |

OTHER PUBLICATIONS

The office action of the corresponding CN application No. 201911042177.7 dated Jan. 27, 2021.

The office action of the corresponding TW application No. 108111219 dated Sep. 16, 2020.

"Tractor Construction", Zhao Jianzhu Zhang Xuemin, pp. 104-105, China Agricultural University Press, Jun. 2016.

The office action of the corresponding CN application No. 201911042177.7 dated Sep. 8, 2021.

* cited by examiner

GENERAL-PURPOSE ENGINE

TECHNICAL FIELD

The present invention relates to a general-purpose engine.

BACKGROUND ART

Conventionally, a general-purpose engine has been known which can be used as a driving source of a small working machine such as a weed trimmer (for example, refer to Patent Document 1). With such a weed trimmer, the general-purpose engine is mounted to a base end of a drive shaft having a blade mounted to the leading end.

Patent Document 1: Japanese Unexamined Patent Application, Publication No. 2017-53233

DISCLOSURE OF THE INVENTION

Problems to be Solved by the Invention

Incidentally, with a small working machine such as a string trimmer, a high-output general-purpose engine despite being small size has been demanded. However, the current situation is that it is not possible to sufficiently cool the engine body with a conventional general-purpose engine when the heating amount generated when making higher output also increases, and thus there has been margin for improvement in the cooling structure.

The present invention has been made taking the above into account, and an object thereof is to provide a general-purpose engine having sufficient cooling performance.

Means for Solving the Problems

A first aspect of the present invention provides a general-purpose engine (for example, the general-purpose engine 1 described later) including: an engine main body (for example, the engine main body 10 described later) having an exhaust-system component (for example, the exhaust-system component 13, exhaust port 131, cannister muffler 132, exhaust valve 133, exhaust valve guide 134 described later) connected to a cylinder (for example, the cylinder 11 described later); and a cooling mechanism (for example, the cooling mechanism 9 described later) which cools the engine main body, in which the cooling mechanism includes: a cooling fan (for example, the cooling fan 90 described later) which generates a cooling air flow by rotating; a blowing part (for example, the blowing part 92 described later) which blows the cooling air flow generated by rotation of the cooling fan; and an air guide (for example, the air guide 93 described later) which guides the cooling air flow blown from the blowing part towards the cylinder and the exhaust-system component.

In the first aspect of the present invention, as the cooling mechanism that cools the engine main body, provided are the cooling fan which generates cooling air flow by rotating, the blowing part which blows the cooling air flow generated by the rotation of the cooling fan, and the air guide which guides the cooling air flow blown by the blowing part towards the cylinder and exhaust-system component. It is thereby possible to efficiently guide the cooling air flow generated by rotation of the cooling fan from the blowing part towards the cylinder and exhaust-system component. For this reason, it is possible to efficiently cool the cylinder and exhaust-system component which tend to become high temperature accompanying the raising of output of the general-purpose engine.

According to a second aspect of the present invention, it is preferable in the first aspect of the present invention for the air guide to include: an air guide main body (for example, the air guide main body 931 described later) of substantially L-shaped cross section which is disposed above the cooling fan, and extends towards the blowing part in a state in which a bend (for example, the bend 933 described later) faces a side of the exhaust-system component; and a fixing part (for example, the fixing part 932 described later) which fixes the air guide main body to a side of the engine main body.

In the second aspect of the present invention, the air guide which guides the cooling air flow blown by the blowing part towards the cylinder and exhaust-system component is configured to include: an air guide main body of substantially L-shaped cross section which is arranged above the cooling fan and extends towards the blowing part in a state in which a bend 933 faces the side of the exhaust-system component; and a fixing part which fixes the air guide main body to the side of the engine main body. It is thereby possible to reliably guide the cooling air flow blown from the blowing part towards the cylinder and exhaust-system component, and thus possible to efficiently cool the cylinder and exhaust-system component.

According to a third aspect of the present invention, it is preferable in the invention as described in the first or second aspect for the blowing part to have a convex part (for example, the convex part 921 described later) which is formed to project to an inner side and directs the cooling air flow towards the air guide.

The third aspect of the present invention provides a convex part which directs the cooling air flow towards the air guide and is formed by projecting to the inner side at the inside of the blowing part. The cooling air flow is thereby directed towards the air guide by the convex part upon being blown from the blowing part. For this reason, it is possible to more reliably guide the cooling air flow blown from the blowing part towards the cylinder and exhaust-system component, and thus possible to more efficiently cool the cylinder and exhaust-system component.

Effects of the Invention

According to the present invention, it is possible to provide a general-purpose engine having sufficient cooling performance.

PREFERRED MODE FOR CARRYING OUT THE INVENTION

Hereinafter, an embodiment of the present invention will be explained in detail while referencing the drawings.

Figure 1:
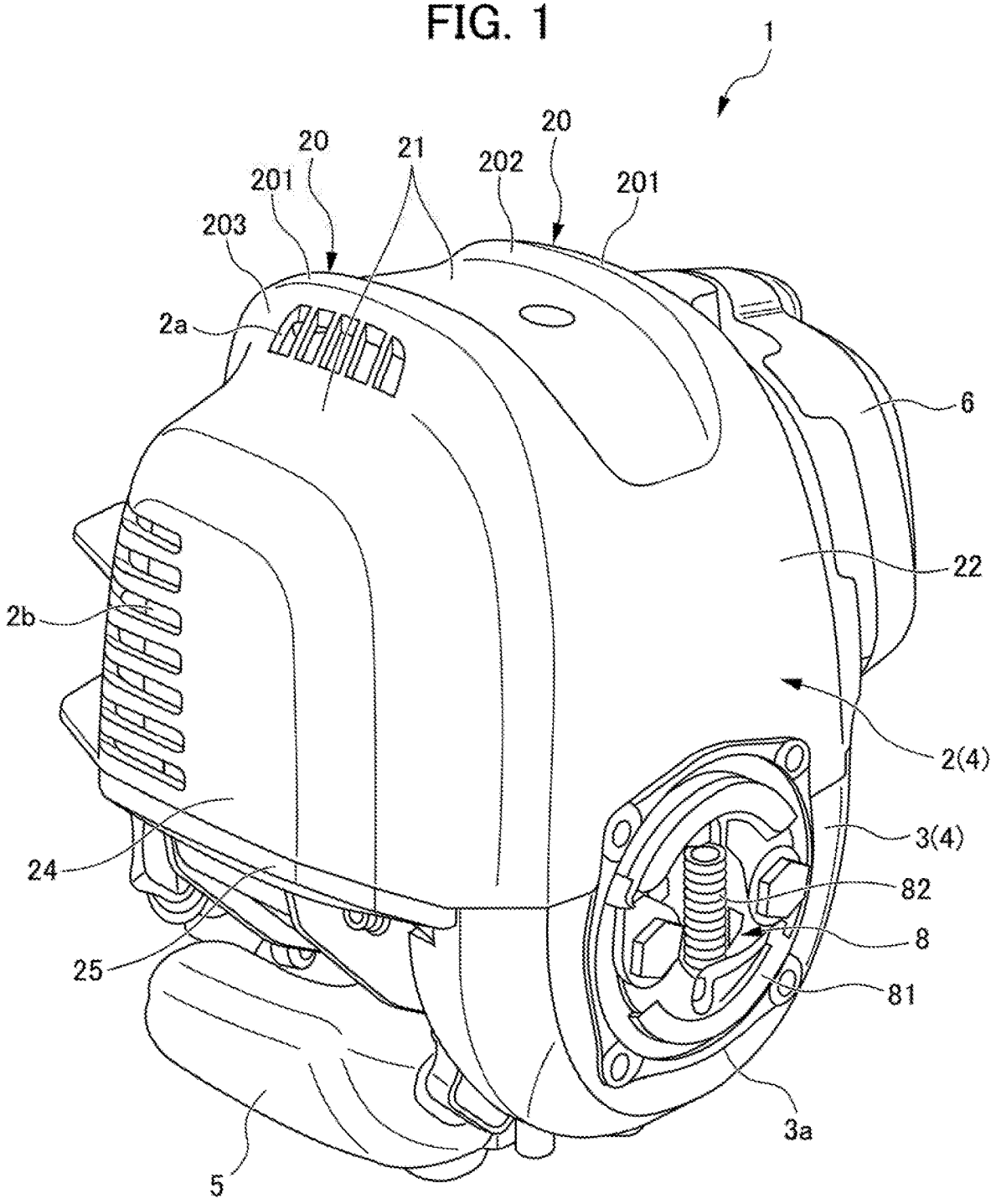
FIG. 1 is a forward perspective view of a general-purpose engine according to an embodiment of the present invention.
Figure 2:
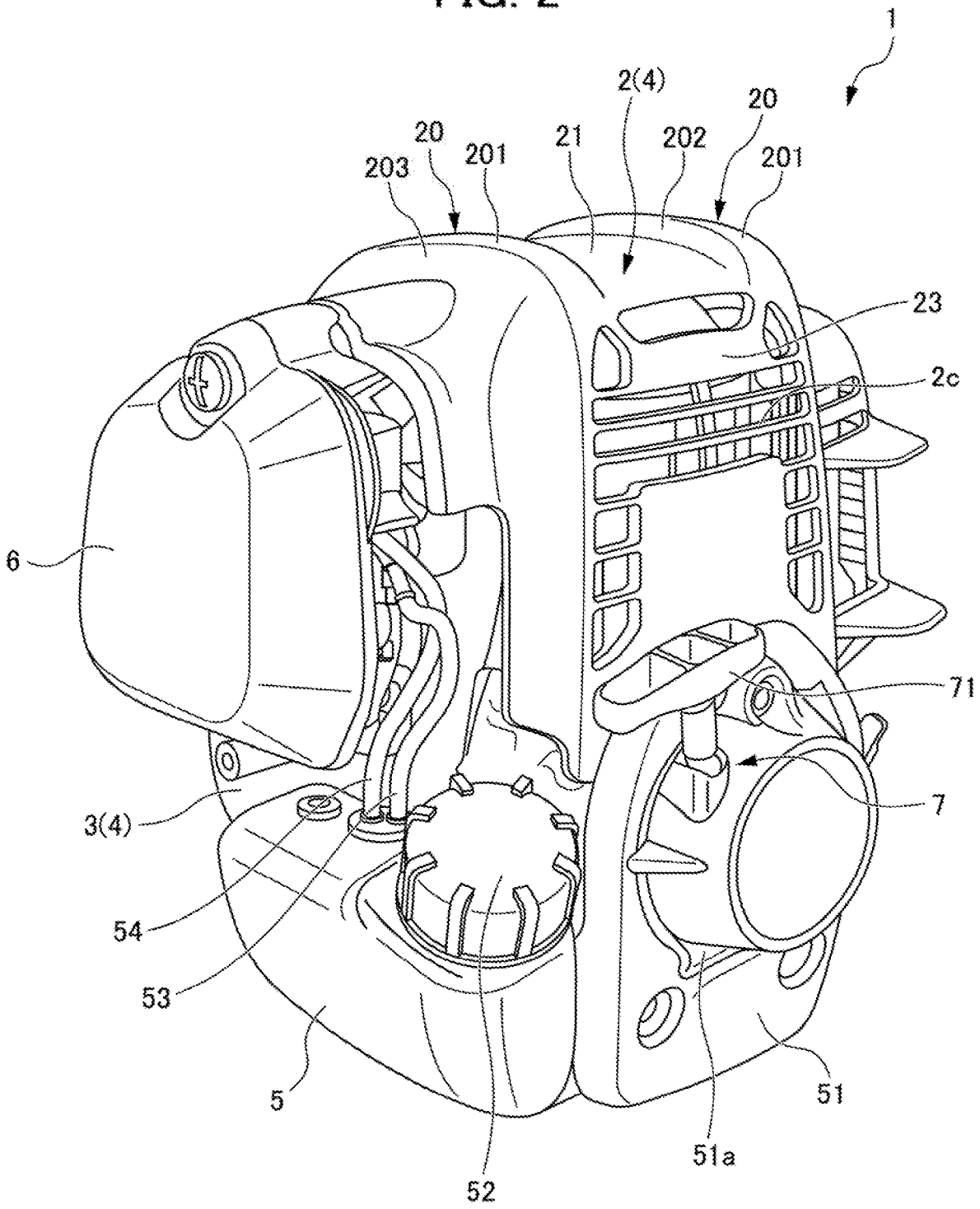
FIG. 2 is a rear perspective view of a general-purpose engine according to an embodiment of the present invention.
Figure 3:
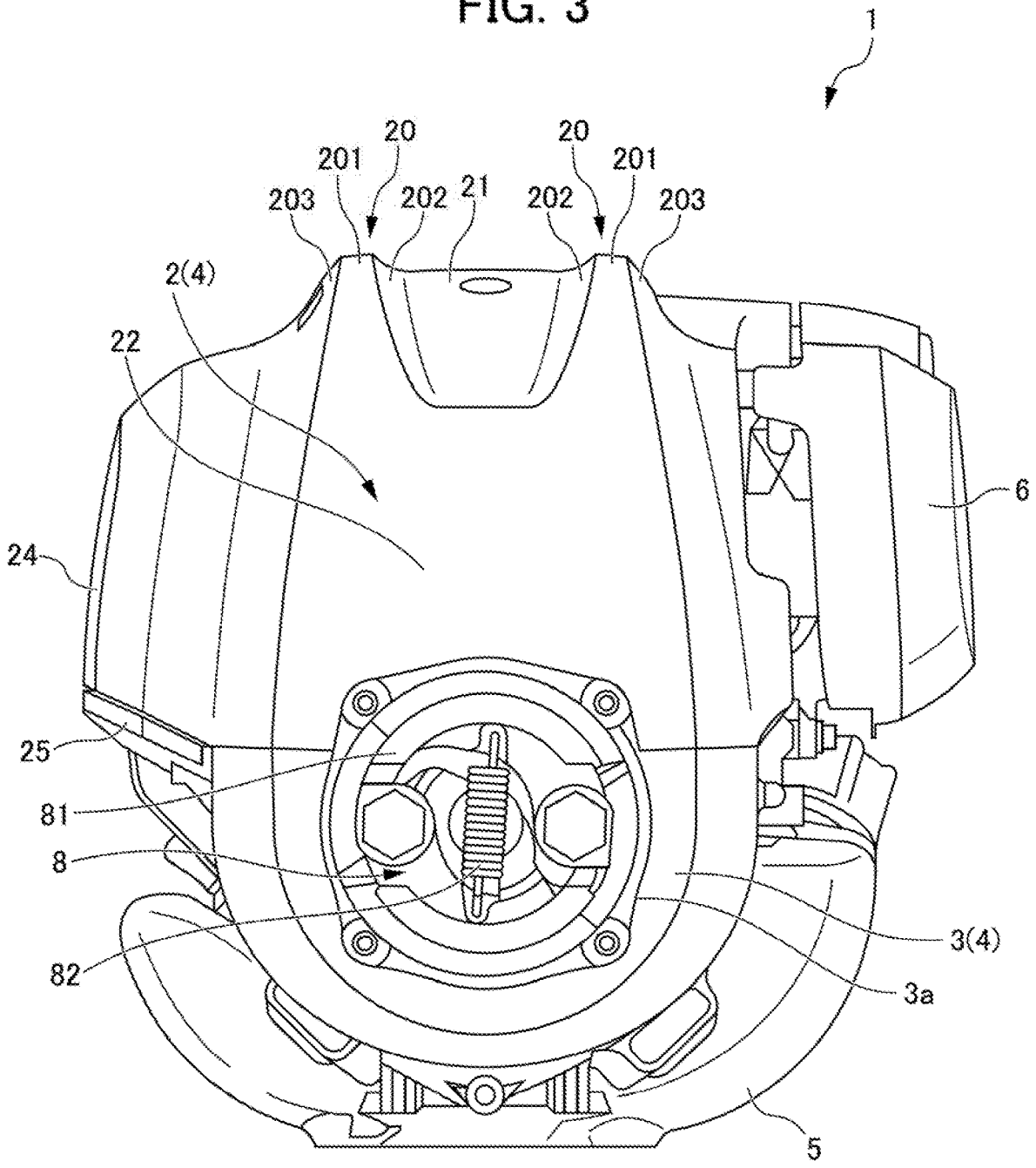
FIG. 3 is a front view of a general-purpose engine according to an embodiment of the present invention.
Figure 4:
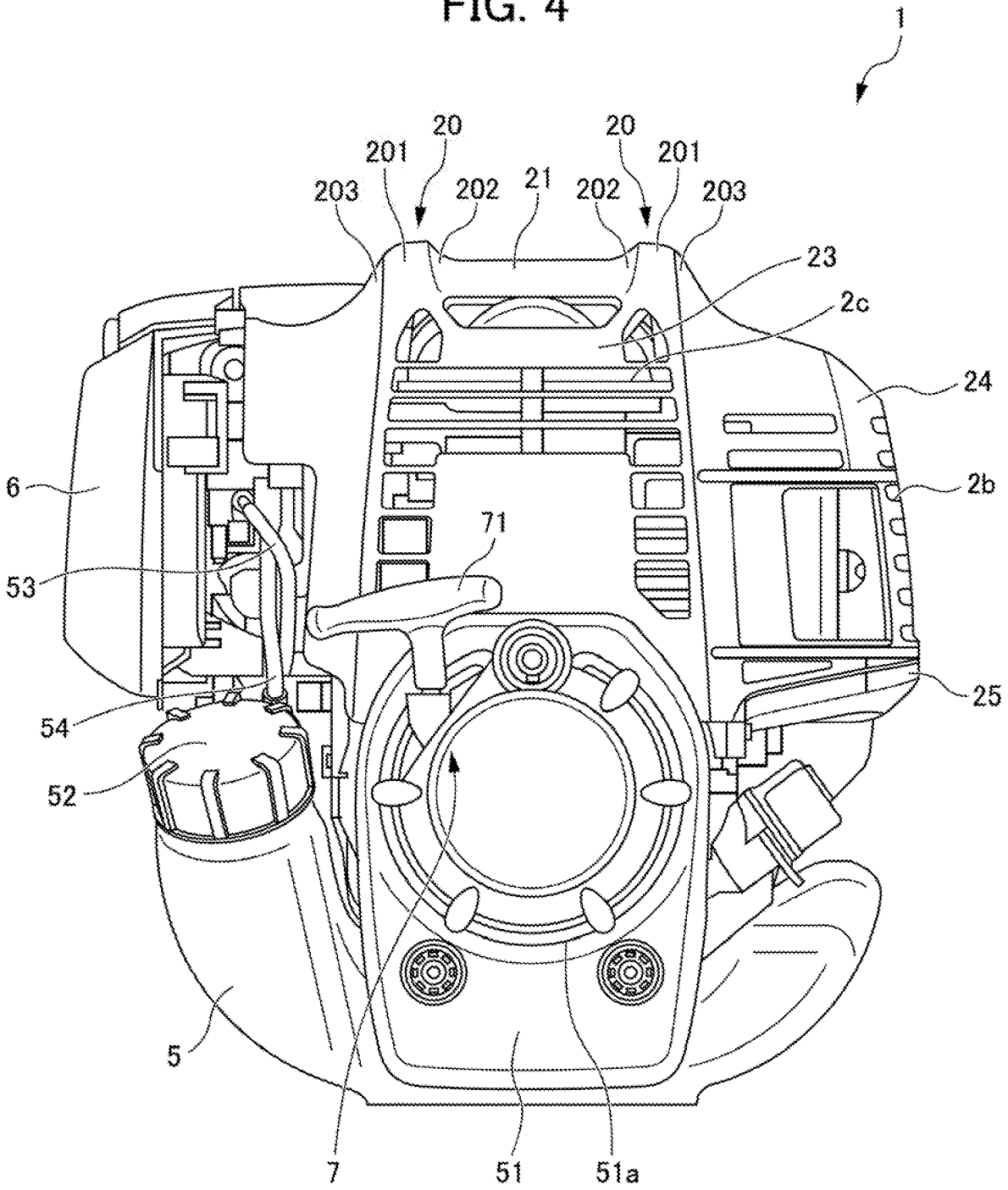
FIG. 4 is a rear view of a general-purpose engine according to an embodiment of the present invention.
Figure 5:
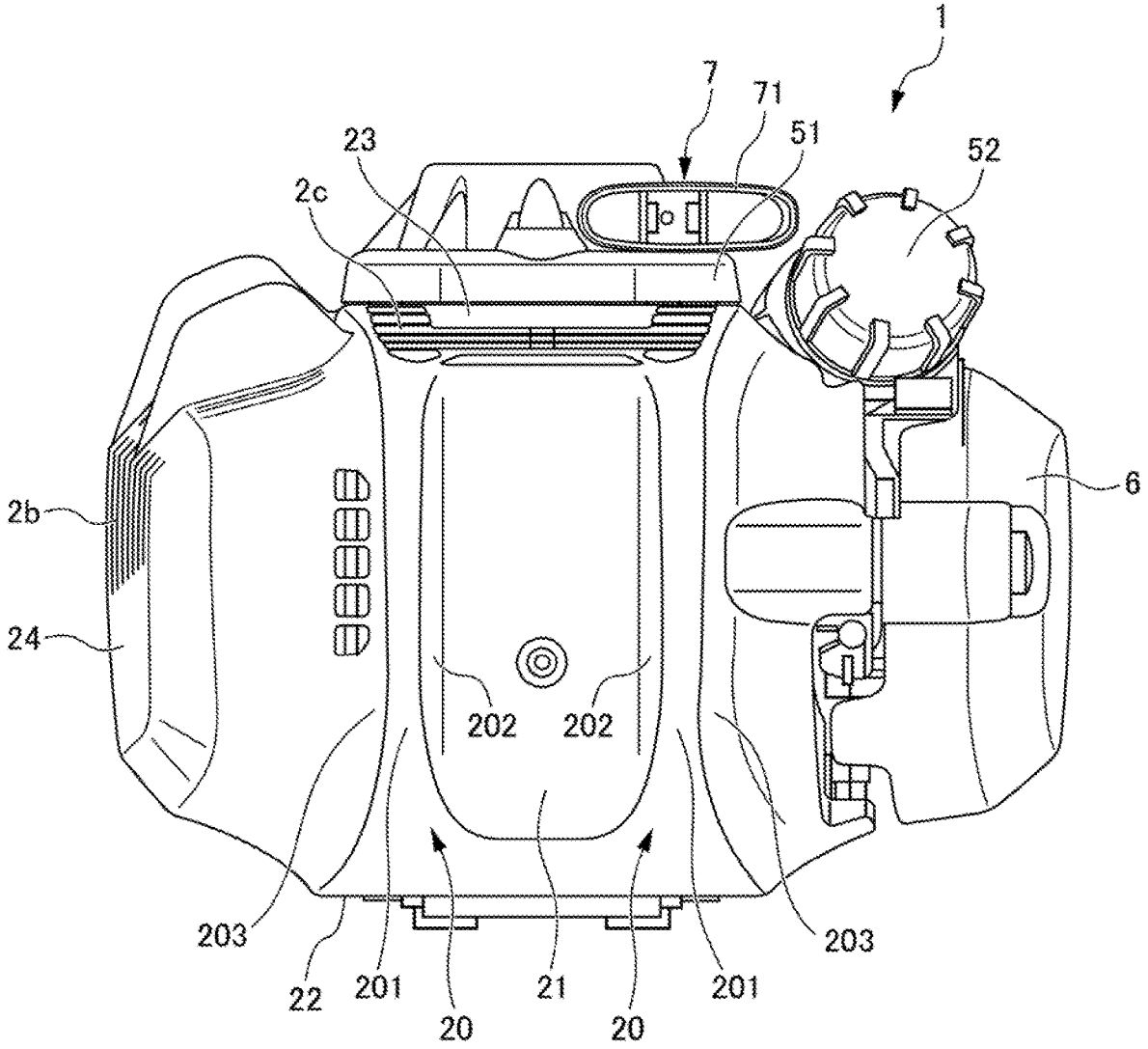
FIG. 5 is a plan view of a general-purpose engine according to an embodiment of the present invention.
Figure 6:
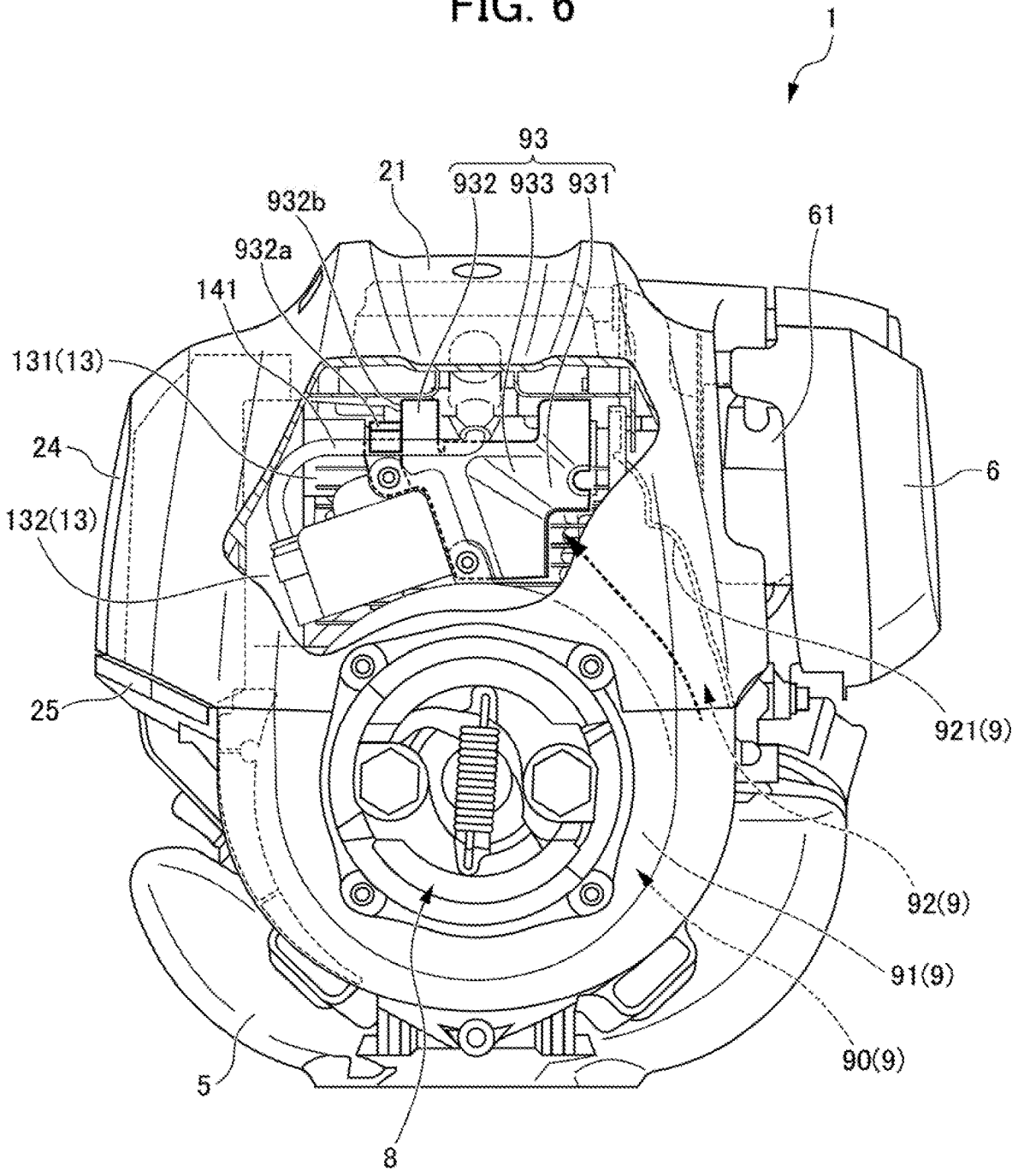
FIG. 6 is a first longitudinal section of a general-purpose engine according to an embodiment of the present invention.
Figure 7:
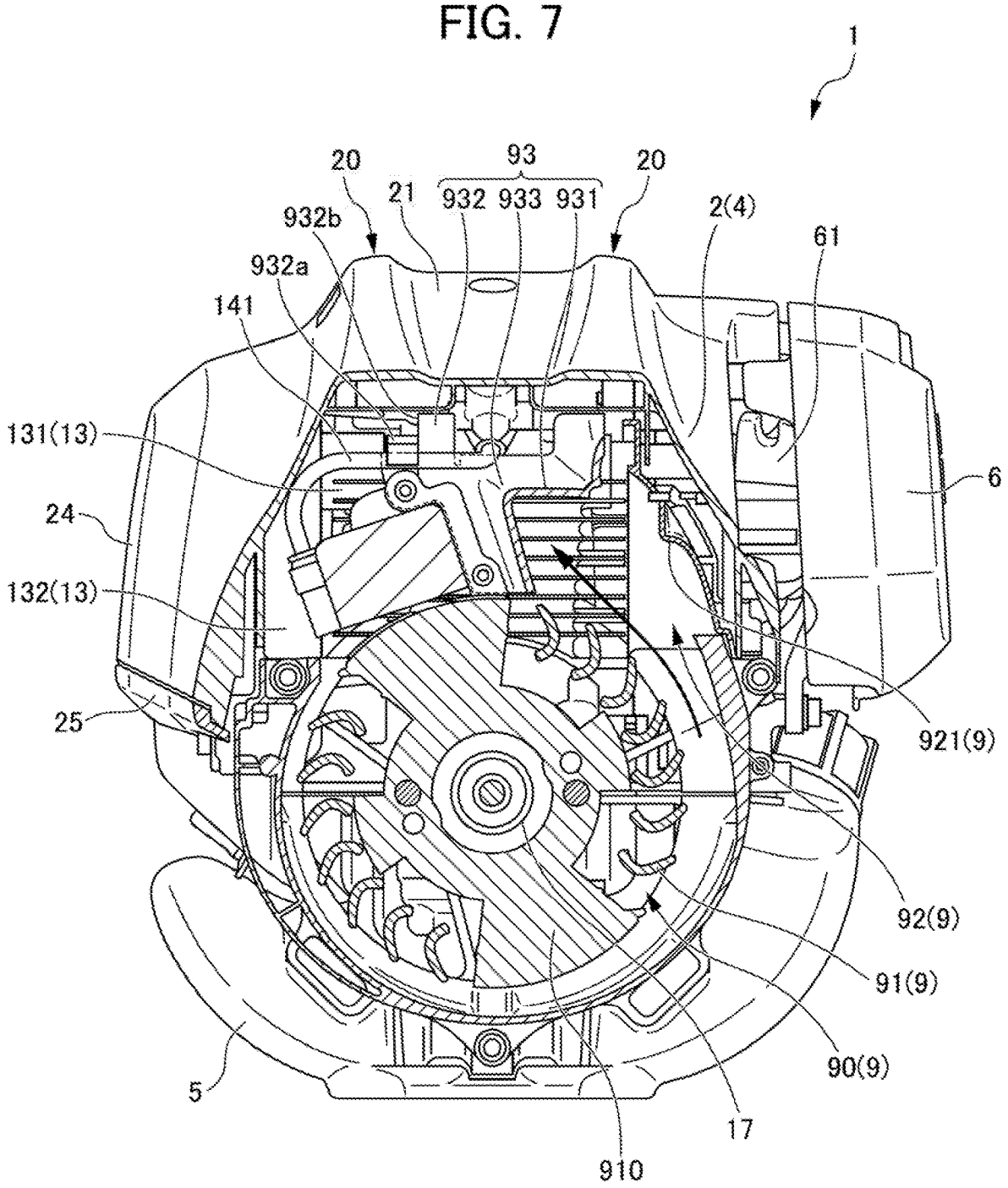
FIG. 7 is a second longitudinal section of a general-purpose engine according to an embodiment of the present invention.
Figure 8:
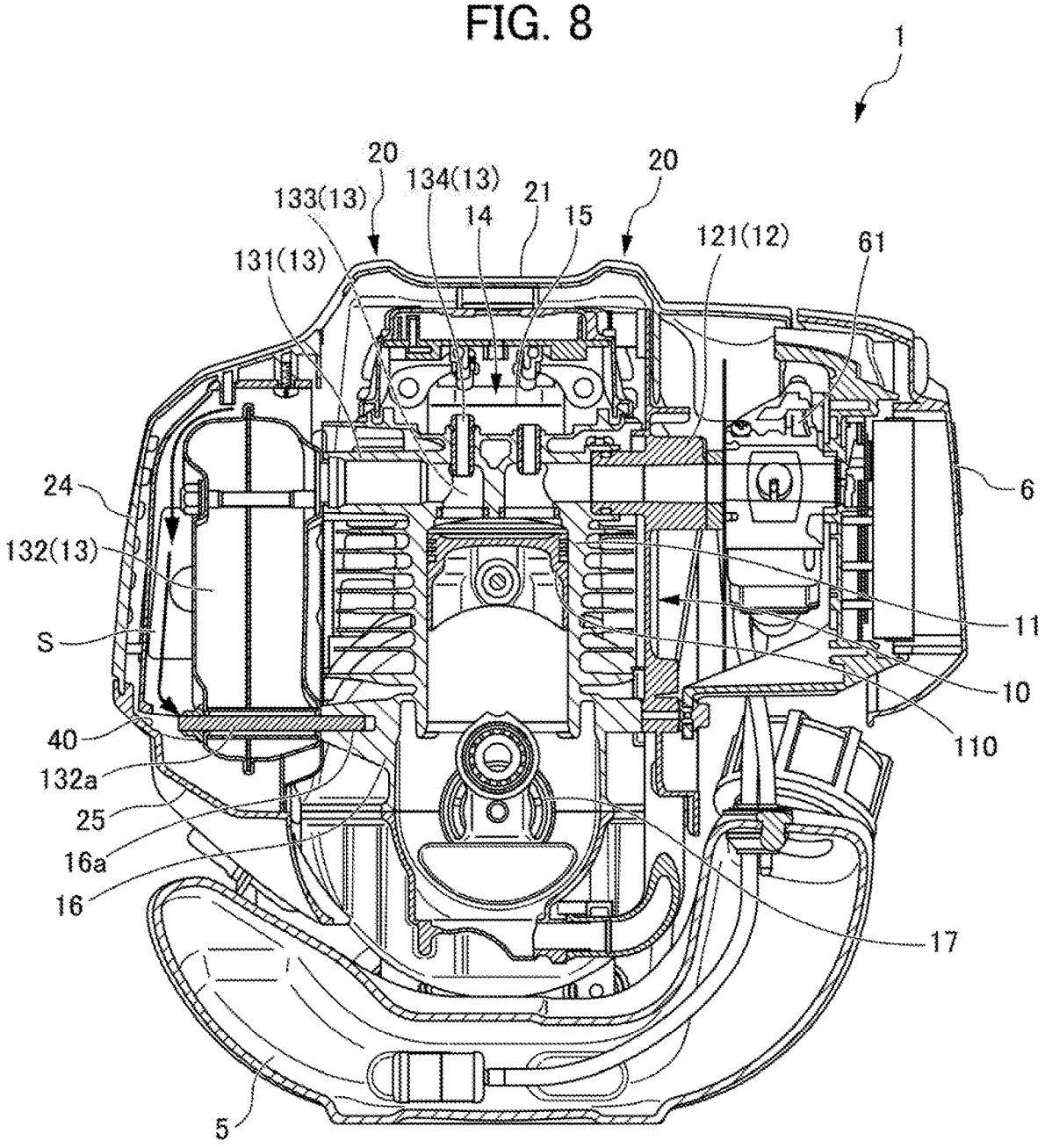
FIG. 8 is a third longitudinal section of a general-purpose engine according to an embodiment of the present invention.
Figure 9:
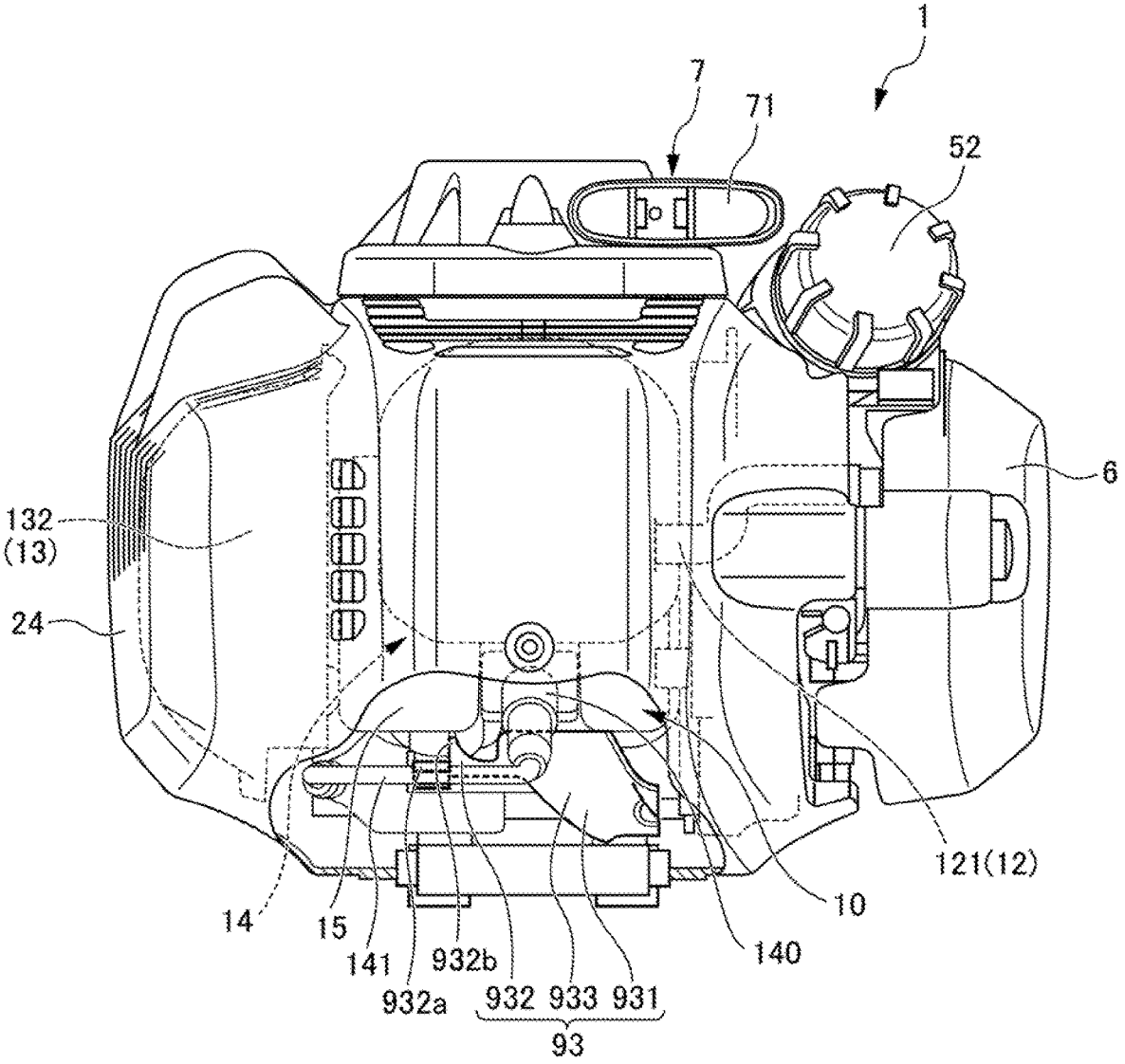
FIG. 9 is a first cross-sectional view of a general-purpose engine according to an embodiment of the present invention.
Figure 10:
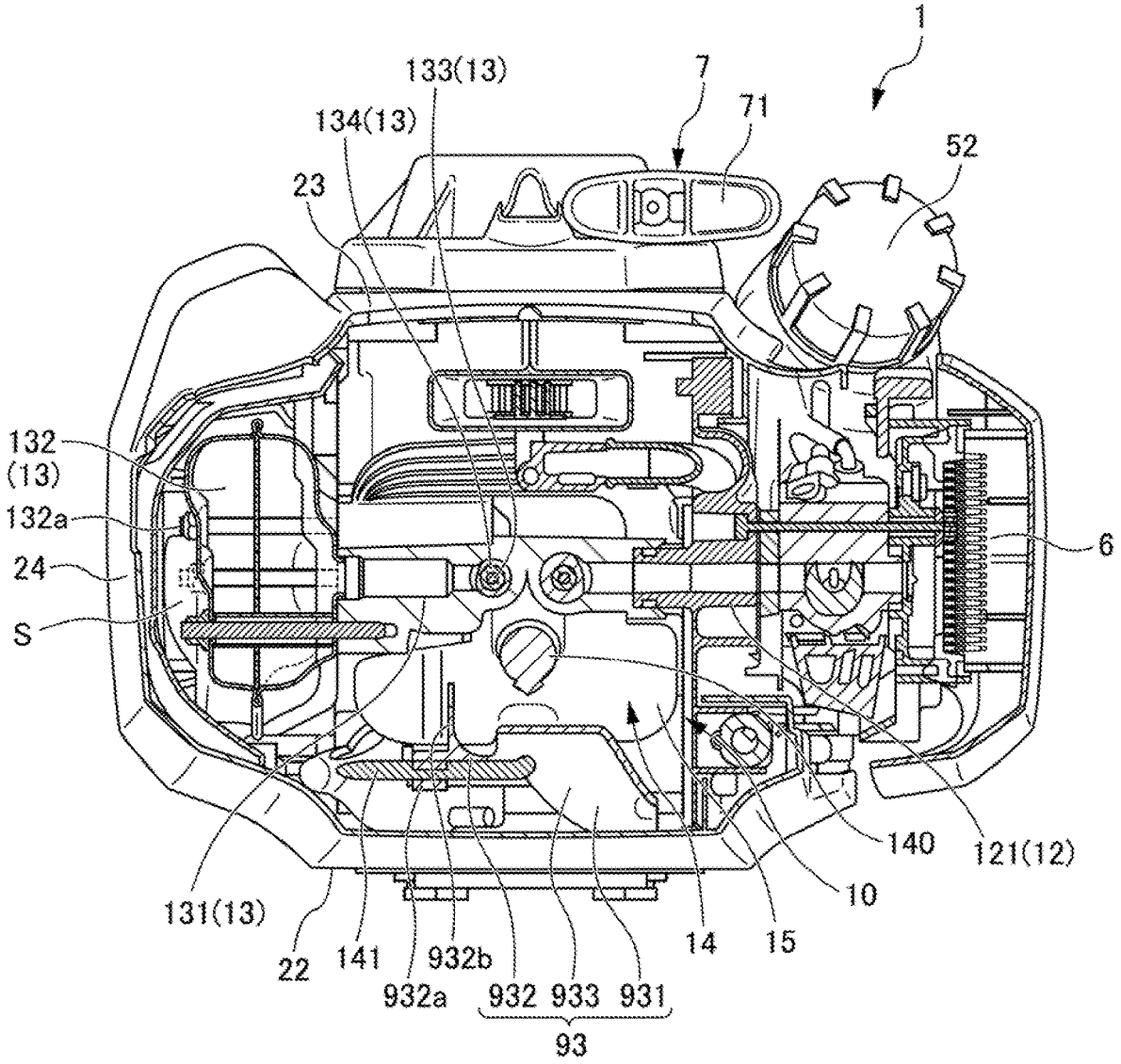
FIG. 10 is a second cross-sectional view of a general-purpose engine according to an embodiment of the present invention.

FIG. 1 is a forward perspective view of a general-purpose engine 1 according to the present embodiment. FIG. 2 is a rear perspective view of a general-purpose engine according to the present embodiment. FIG. 3 is a front view of a general-purpose engine according to the present embodiment. FIG. 4 is a rear view of a general-purpose engine according to the present embodiment. FIG. 5 is a plan view of a general-purpose engine according to the present embodiment. FIG. 6 is a first longitudinal section of a general-purpose engine 1 according to the present embodiment. FIG. 7 is a second longitudinal section of a general-purpose engine 1 according to the present embodiment. FIG. 8 is a third longitudinal section of a general-purpose engine 1 according to the present embodiment. FIG. 9 is a first cross-sectional view of a general-purpose engine 1 according to the present embodiment. FIG. 10 is a second cross-sectional view of a general-purpose engine 1 according to the present embodiment.

Herein, the third longitudinal section of FIG. 8 is a longitudinal section more to a side of a front surface 22 of a top cover 2 than the second longitudinal section of FIG. 7, and the second longitudinal section of FIG. 7 is a longitudinal section more to the side of the front surface 22 of the top cover 2 than the first longitudinal section of FIG. 6. In addition, the second cross-sectional view of FIG. 10 is a cross-sectional view lower than the first cross-sectional view of FIG. 9. FIG. 6 is a partial longitudinal section, and FIG. 9 is a partial cross-sectional view. It should be noted that general-purpose engine indicates a multipurpose engine for which the application is not specified, such as for automobiles or motorcycles.

The general-purpose engine 1 according to the present embodiment can be used as a driving source of a small-scale working machine such as a weed trimmer, for example. The general-purpose engine 1 is a four-stroke engine of higher horsepower than conventional, irrespective of its small scale. The general-purpose engine 1 can run even if tilted 360 degrees, and is suitable as the driving source of hand-held work machines such as a weed trimmer. In the case of being used in a weed trimmer, the general-purpose engine 1 is attached to a base end of a drive shaft to which a blade is attached at the leading end.

The general-purpose engine 1 includes: an engine main body 10; a cooling mechanism 9; a shroud 4 configured to include a top cover 2, bottom cover 3 and inner cover 25; a fuel tank 5; an air cleaner 6; a recoil starter 7; a tank guard 51; a refilling cap 52; a fuel tube 53; a fuel return tube 54; and a centrifugal clutch 8.

The engine main body 10 has: a cylinder block 14; and a crank case 16 which is connected to the cylinder block 14. The cylinder block 14 has a cylinder 11 and cylinder head 15 formed integrally. The cylinder 11 accommodates a piston 110 to be slidable, and the piston 110 is connected to a crank shaft 17. A spark plug 140; intake-system component 12 having an intake port 121; and an exhaust-system component 13 having an exhaust port 131, cannister muffler 132, exhaust valve 133, exhaust valve guide 134 supporting the exhaust valve 133, etc. are attached to the cylinder 11. The crank case 16 supports the crank shaft 17.

The cooling mechanism 9 supplies cooling air for cooling the engine main body 10. This cooling mechanism 9 is described in detail at a later stage.

The top cover 2 is arranged at the upper part of the general-purpose engine 1, and is a cover which covers the upper part of the engine main body 10 (cylinder block 14, crank case 16, etc.). The top cover 2 is a cover of substantially dome shape in which the bottom is open, and is formed so as to cover the cylinder block 14, etc. in which the cylinder 11 and cylinder head 15 are formed integrally. In addition, on one side among both sides of the general-purpose engine 1 (left side in the drawing), the exhaust port 131 and cannister muffler 132 are arranged to be accommodated, and the top cover 2 is formed so as to cover these. It should be noted that the cannister muffler 132 is arranged between the fuel tank 5 described later and the engine main body 10, and reduces the sound (exhaust sound) generated upon exhaust being emitted to outside and sound (intake sound) generated upon air being drawn into the intake plumbing, as well as preventing transpiration by reducing the pressure and temporarily capturing thermally expanded vaporized fuel.

A plurality of ventilation ports is formed in the top cover 2. More specifically, a top ventilation port 2*a*, side ventilation port 2*b* and back ventilation port 2*c* are formed. This top ventilation port 2*a*, side ventilation port 2*b* and back ventilation port 2*c* are used in the release of heat generated from the engine main body 10, particularly the cylinder 11 and exhaust-system component 13. In addition, cooling air from a cooling fan 90 described later is used in the cooling of the engine main body 10, etc., and is then released from this plurality of ventilation ports.

The top ventilation port 2*a* is formed in an outside surface part 203 constituting the outside surface of a bridge part 20 described later, on the left side of the general-purpose engine 1 to which the above-mentioned exhaust system is arranged. The top ventilation port 2*a* is configured by a plurality of notches extending obliquely upwards from an outer side towards the inner side. The side ventilation port 2*b* is formed in a left-side surface 24 of the general-purpose engine 1 to which the above-mentioned exhaust system is arranged. The side ventilation port 2*b* is configured by a plurality of notches extending in the front/rear direction on the back side of the left-side surface 24. The back ventilation port 2*c* is formed along a wide range of the back surface 23 of the top cover 2. The back ventilation port 2*c* is configured by a plurality of notches of different length extending in the left/right direction.

In addition, in the upper surface 21 of the top cover 2, a pair of bridge parts 20, 20 are formed so as to be arranged opposingly. This pair of bridge parts 20, 20 has symmetrical shapes to each other relative to a central part of the upper surface 21 of the top cover 2. The pair of bridge parts 20, 20 is formed so as to project from the upper surface 21 of the top cover 2, and constitutes an apex of the top cover 2. In addition, this pair of bridge parts 20, 20 extends to connect from the front surface 22 of the top cover 2 until the back surface 23 through the upper surface 21. In other words, the front surface 22 and back surface 23 of the top cover 2 are bridged by this pair of bridge parts 20, 20.

The pair of bridge parts 20, 20 respectively has: a surface part 201 constituting the surface thereof; and an inside surface part 202 constituting an inner surface and an outside surface part 203 constituting the outer surface, which link the surface part 201 and the upper surface 21 of the general-purpose engine 1. This pair of bridge parts 20, 20 is arranged opposingly in substantially parallel in a plan view of the general-purpose engine 1 as shown in FIG. 5.

The surface part 201 constituting the surface of each bridge part 20 is continuous with the front surface 22 of the top cover 2 without a step, and is also continuous with the back surface 23 of the top cover 2 without a level step. The surface part 201, in a front view of the general-purpose engine 1, has a tapered shape in which the width narrows moving upwards. Similarly, also in the back view of the general-purpose engine 1, it has a tapered shape in which the width narrows moving upwards. For this reason, in a plan view of the general-purpose engine 1 as shown in FIG. 5, in the pair of bridge parts 20, 20, the width dimension increases towards the front surface 22 side, and similarly, the width dimension increases towards the back surface 23 side. Even in a case of increasing the size due to raising output of the general-purpose engine 1, and the width increasing, as a result of the line of sight being guided to the longitudinal direction by the pair of bridge parts 20, 20, it thereby comes to give a slim impression in the shape as a whole, and seems to be small.

In addition, the surface part 201 constituting a surface of each bridge part 20 slopes downwards as approaching the outside, in a front view of the general-purpose engine 1. In other words, the surface parts 201, 201 of the pair of bridge parts 20, 20 are positioned higher towards the inside and positioned lower towards the outside. In the case of placing the general-purpose engine 1 upside down, since both inside portions of the surface parts 201, 201 of the pair of bridge parts 20, 20 contact the placement surface preferentially, the pair of bridge parts 20, 20 thereby function as supports, and a stable posture is secured. At the same time, the placement surface area decreases without the upper surface 21 of the general-purpose engine 1 directly contacting the placement surface, and the upper surface 21 is prevented from being damaged, and thus protection of the label attached to the upper surface 21 becomes possible.

The inside surface part 202 constituting the inner surface linking the surface of each bridge part 20 and the upper surface 21 of the top cover 2 slopes to the outer side as approaching the surface of the bridge part 20 from the upper surface 21 of the general-purpose engine 1, in a front view of the general-purpose engine 1. In other words, the inside surface parts 202, 202 of the pair of bridge parts 20, 20 are formed so as to separate from each other as approaching towards the surface of each bridge part 20 from the upper surface 21 of the top cover 2. In the case of the general-purpose engine 1 being placed in a state upside down, as a result of the force in the outside direction acting on the pair of bridge parts 20, 20 functioning as supports, a more stable posture is thereby secured.

The outside surface part 203 constituting the outside surface linking the surface of each bridge part 20 and the upper surface 21 of the top cover 2 slopes downwards towards the outside. A much sharper and slimmer external shape thereby comes to be obtained.

The bottom cover 3 is arranged at the lower part of the general-purpose engine 1, and is a cover which covers the lower part of the engine main body 10. The bottom cover 3 is a cover of substantially semicircular shape in the front view of the general-purpose engine 1, and is formed so as to cover the cooling fins 91 provided to a flywheel 910 which is connected to rotate with the crankshaft 17, the crank case 16 which is connected to the above-mentioned cylinder block 14, etc. It should be noted that the flywheel 910 makes it possible to achieve smooth low speed rotation of the general-purpose engine 1 having a small number of cylinders using the inertia during rotation. In the present embodiment, a plurality of cooling fins 91 is formed at the circumferential edge of this flywheel 910, whereby the cooling fan 90 is configured.

In the front surface side of the bottom cover 3, a connection hole 30 to which the drive shaft of the weed trimmer (not illustrated) is connected is formed. Inside this connection hole 30, the centrifugal clutch 8 which engages or disengages the drive shaft by only an increase/decrease in rotation speed of the crank shaft 17 is arranged, and the drive shaft is engaged to the crankshaft 17 via this centrifugal clutch 8. It should be noted that, with the centrifugal clutch 8, the torque is transmitted by the clutch shoe 81 rotating together with the crankshaft 17 being pressed against the clutch drum on the drive shaft by way of centrifugal force, and the torque transmission is disengaged by the clutch shoe 81 being distanced from the clutch drum by way of the resilience of a spring 82 as the rotation speed of the crankshaft 17 declines and centrifugal force weakens.

As explained above, the shroud 4 configured to include the top cover 2, bottom cover 3 and inner cover 25 is formed so as to cover the engine main body 10 which is configured to include the cylinder block 14 in which the cylinder 11 and cylinder head 15 are formed integrally, and the crank case 16 which is coupled to this cylinder block 14. The shroud 4 is configured from a resin member, and is fixed by bolts to the engine main body 10. The shape of this shroud 4 mainly constitutes the external shape of the general-purpose engine 1.

The fuel tank 5 is arranged at a lower part of the general-purpose engine 1. The fuel tank 5 constitutes the overall lower part of the general-purpose engine 1, and extends substantially in an arc shape in a front view of the general-purpose engine 1. Laterally on the intake side to which the air cleaner 6 is arranged, among both sides of the general-purpose engine 1 (right side in drawing), a refilling cap 52 which blocks the fuel filling opening, a fuel tube 53 which supplies fuel to the engine main body, and a fuel return tube 54 which circulates fuel to the fuel tank 5 are arranged at the fuel tank 5.

A tank guard 51 which is a plate-shaped protective member covering the back surface side of the fuel tank 5, and extending in the up/down direction at the central portion in the left/right direction of the general-purpose engine 1 is arranged at the back surface side of the fuel tank 5. In this tank guard 51, mounting holes 51*a* for mounting the recoil starter 7 are formed. It should be noted that the recoil starter 7 is configured to include a pulley (not illustrated) in addition to a grip 71, a rope which is wound around the pulley and connected to the grip 71, etc., and causes the general-purpose engine 1 to start by giving rotational force to the crank shaft 17 by the manipulation of the grip 71 by the user.

The air cleaner 6 is arranged at a side of the intake side among both sides of the general-purpose engine 1 (right side in the drawing). The air cleaner 6 is connected to an upstream side of a carburetor 61, and purifies the intake air.

Next, the cooling mechanism 9 of the general-purpose engine 1 according to the present embodiment will be explained in detail while referencing FIGS. 6 to 10.

The cooling mechanism 9 of the present embodiment has the cooling fan 90, blowing part 92, and air guide 93.

The cooling fan 90 is configured by a plurality of cooling fins 91 being formed at the periphery of the flywheel 910 as mentioned above. This cooling fan 90 rotates by the flywheel coaxially arranged with the crankshaft 17 integrally rotating by way of rotation of this crankshaft 17, thereby generating cooling air.

The blowing part 92 blows the cooling air generated by rotation of the cooling fan 90 into the general-purpose engine 1. The blowing part 92 is arranged at the side of the intake side of the cooling fan 90 (right side in the drawing). The blowing part 92 becomes a channel through which the cooling air flows, and a convex part 921 which directs the cooling air towards the air guide 93 is formed by projecting to the inner side at the inside of the blowing part 92. In more detail, the convex part 921 is formed to project towards the inner side at the outer circumferential part of the channel outlet constituting the blowing part 92.

The air guide 93 guides the cooling air blown from the blowing part 92 towards the cylinder 11 and exhaust-system component 13 (exhaust port 131, cannister muffler 132, exhaust valve 133, exhaust valve guide 134, etc.; same below). The air guide 93 is arranged above the cooling fan 90. In addition, the air guide 93 has: an air guide main body 931 of substantially L-shaped cross section which extends towards the blowing part 92 in a state in which a bend 933 faces the side of the exhaust-system component 13; and a fixing part 932 which fixes the air guide main body 931 to the side of the engine main body 10.

In more detail, the air guide main body 931 obliquely extends towards the side of the engine main body 10 from the side of the front surface 22 of the general-purpose engine 1, as approaching the side of the exhaust-system component 13 from the side of the blowing part 92. The cooling air blown from the blowing part 92 thereby comes to be guided more reliably to the engine main body 10 and exhaust-system component 13.

In addition, the fixing part 932 has: a fitting part 932*a* which is fitted by a high-tension cord connected to the spark plug 140 being inserted; and an engaging part 932*b* which projects towards the side of the cylinder block 14 and engages with the gap of the cylinder block 14. The air guide main body 931 is fixed to the engine main body 10 by this fitting part 932*a* and engaging part 932*b*.

Next, cooling to a stud bolt 132*a*, which is a fixture of the cannister muffler 132 of the general-purpose engine 1 according to the present embodiment, will be explained in detail by referencing FIG. 8, etc.

As shown in FIG. 8, a space S through which the cooling air blown towards the upper part of the engine main body 10 from the blowing part 92 can flow from above to below is formed between the shroud 4 and cannister muffler 132. This space S is formed by the left-side surface 24 on the side of the exhaust-system component 13 of the top cover 2 constituting the shroud 4 swelling to the outer side. The space S is formed from the upper part to the lower part of the cannister muffler 132, and a clearance between the cannister muffler 132 is secured to be larger moving downwards. By this space S, the cooling air from the upper part of the engine main body 10 (cylinder block 14, etc.) is flowed to the circumference of the cannister muffler 132, whereby the cannister muffler 132 is cooled.

In addition, a return part 40 guiding the cooling air towards the stud bolt 132*a* fixing the cannister muffler 132 to the engine main body 10 is formed at the inner wall surface of the shroud 4 (left-side surface 24 on the exhaust-system component 13 side of the top cover 2) forming the space S. The return part 40 is arranged between the top cover 2 and the bottom cover 3, and is formed in the inner cover 25 constituting the shroud 4. In more detail, the return part 40 is formed by the inner wall surface of the inner cover 25 projecting to the inner side, towards the stud bolt 132*a* arranged at the lower part of the cannister muffler 132. In the longitudinal sectional view shown in FIG. 8, the return part 40 has a sloped surface which slopes downwards more as moving to the inner side. The cooling air which can flow in from above is guided towards the stud bolt 132*a* by this sloped surface.

It should be noted that the stud bolt 132*a* to which the cooling air is guided by the above-mentioned return part 40 is arranged at the lower part of the cannister muffler 132. Other than the stud bolt 132*a* arranged at the lower part, although the fixtures of the cannister muffler 132 are also arranged at the upper part and center part of the cannister muffler 132 (refer to FIGS. 8 and 10), it is effective to guide cooling air to the stud bolt 132*a* arranged at the lower part of the cannister muffler 132 which tends to keep the most heat and tends to become high temperature. As shown in FIG. 8, the leading end of the stud bolt 132*a* is fixed by being inserted into a boss 16*a*, which is a mounting part of the crank case 16 constituting the engine main body 10.

The effects exerted by the general-purpose engine 1 according to the present embodiment equipped with the above configuration will be explained below by referencing FIGS. 6 to 10.

In the present embodiment, as the cooling mechanism 9 that cools the engine main body 10, provided are the cooling fan 90 which generates cooling air flow by rotating, the blowing part 92 which blows the cooling air flow generated by the rotation of the cooling fan 90, and the air guide 93 which guides the cooling air flow blown by the blowing part 92 towards the cylinder 11 and exhaust-system component 13. It is thereby possible to efficiently guide the cooling air flow generated by rotation of the cooling fan 90 from the blowing part 92 towards the cylinder 11 and exhaust-system component 13. For this reason, it is possible to efficiently cool the cylinder 11 and exhaust-system component 13 which tend to become high temperature accompanying the raising of output of the general-purpose engine 1.

In addition, in the present embodiment, the air guide 93 which guides the cooling air flow blown by the blowing part 92 towards the cylinder 11 and exhaust-system component 13 is configured to include: an air guide main body 931 of substantially L-shaped cross section which is arranged above the cooling fan 90 and extends towards the blowing part 92 in a state in which a bend 933 faces the side of the exhaust-system component 13; and a fixing part 932 which fixes the air guide main body 931 to the side of the engine main body 10. It is thereby possible to reliably guide the cooling air flow blown from the blowing part 92 towards the cylinder 11 and exhaust-system component 13 by receiving with the air guide main body 931 of substantially L-shaped cross section, and thus possible to efficiently cool the cylinder 11 and exhaust-system component 13.

In addition, the present embodiment provides a convex part 921 which directs the cooling air flow towards the air guide 93 and is formed by projecting to the inner side at the inside of the blowing part 92. The cooling air flow is thereby directed towards the air guide 93 by the convex part 921 upon being blown from the blowing part 92. For this reason, it is possible to more reliably guide the cooling air flow blown from the blowing part 92 towards the cylinder 11 and exhaust-system component 13, and thus possible to more efficiently cool the cylinder 11 and exhaust-system component 13.

It should be noted that the present invention is not to be limited to the above-mentioned embodiment, and that modifications and improvements within a scope which can achieve the objects of the present invention are encompassed by the present invention.

EXPLANATION OF REFERENCE NUMERALS

1 general-purpose engine
10 engine main body
11 cylinder
13 exhaust-system component
90 cooling fan
91 cooling fan
92 blowing part
93 air guide
131 exhaust port (exhaust-system component)
132 cannister muffler (exhaust-system component)
133 exhaust valve (exhaust-system component)
134 exhaust valve guide (exhaust-system component)
921 convex part
931 air guide main body
932 fixing part
932*a* fitting part
932*b* engaging part
933 bend

The invention claimed is:

1. A general-purpose engine comprising an engine main body having an exhaust-system component connected to a cylinder; and a cooling mechanism which cools the main engine body, wherein the cooling mechanism includes:

a cooling fan which generates a cooling air flow by rotating;

a blowing part which blows the cooling air flow generated by rotation of the cooling fan; and an air guide which guides the cooling air flow blown from the blowing part, wherein the exhaust-system component is disposed on one side of the general-purpose engine, and wherein the blowing part is disposed on another side of the general-purpose engine, wherein the air guide main body extends from a side of the air blowing part towards a side of the exhaust-system component, to slope from a front surface side of the general-purpose engine on which the cooling fan is provided to inwards of the general-purpose engine and towards a side of the exhaust-system component.

2. The general-purpose engine according to claim 1, wherein the cooling fan includes cooling fins formed on a flywheel disposed coaxially with a crankshaft provided to the engine main body, and wherein the air guide has an air guide main body which extends to slope from a front surface side of the general-purpose engine to inwards of the general-purpose engine.

3. The general-purpose engine according to claim 2, wherein the air guide main body is disposed above the cooling fan, and is a substantially L-shaped in a cross section in which a bend faces a side of the exhaust-system component.

4. The general-purpose engine according to claim 3, wherein the air guide has a fixing part which fixes the air guide main body to the engine main body, and a fitting part which is fitted by a high-tension cord connected to a spark plug being inserted.

5. The general-purpose engine according to claim 2, wherein the blowing part has a convex part which is formed to project to an inner side.

6. The general-purpose engine according to claim 5, wherein the air guide has a fixing part which fixes the air guide main body to the engine main body, and a fitting part which is fitted by a high-tension cord connected to a spark plug being inserted.

7. The general-purpose engine according to claim 2, wherein the air guide has a fixing part which fixes the air guide main body to the engine main body, and a fitting part which is fitted by a high-tension cord connected to a spark plug being inserted.

8. The general-purpose engine according to claim 1, wherein the air guide has a fixing part which fixes the air guide main body to the engine main body, and a fitting part which is fitted by a high-tension cord connected to a spark plug being inserted.

9. The general-purpose engine according to claim 1, wherein the blowing part is disposed on the opposite side of the exhaust-system component with respect to the cylinder.

* * * * *